United States Patent [19]

Ney

[11] 3,953,757

[45] Apr. 27, 1976

[54] SOLDER SEALED LIGHT BULB

[76] Inventor: Robert Johan Ney, 484 Braves Trail Lane, Media, Pa. 19063

[22] Filed: Feb. 26, 1975

[21] Appl. No.: 553,233

[52] U.S. Cl. ..... 313/222; 313/315
[51] Int. Cl.[2] ..... H01K 1/38
[58] Field of Search ..... 313/222, 315

[56] References Cited

UNITED STATES PATENTS

| | | | |
|---|---|---|---|
| 3,040,204 | 6/1962 | Belknap | 313/315 |
| 3,275,879 | 9/1966 | Demarest et al. | 313/315 X |

*Primary Examiner*—James B. Mullins
*Assistant Examiner*—Darwin R. Hostetter

[57] ABSTRACT

The Solder Sealed Light Bulb utilizes a solder exhaust port seal and lead seal combination. Solder glass, or metal solder may be used for the seal material. Evacuation is accomplished in a vacuum furnace. The bulb assembly is evacuated thru the openings at the solder plug, the application of heat liquefies the solder, and surface tension causes the openings to close. Upon cooling, a high vacuum seal is obtained.

2 Claims, 3 Drawing Figures

SOLDER SEALED LIGHT BULB

Brief Description

For large volume production of miniature light bulbs or other vacuum devices, it is imperative that the manufacturing process be simplified to the essential functions, and all unnecessary operations be eliminated. This invention teaches us to use simple basic components and combine functions to obtain a high vacuum envelope so that considerable cost saving is achieved compared to the state of the art devices. In state of the art planar or conical solder seals the mating parts are pressed together at sealing in order to reduce the solder gap and to fill any voids in the solder. In radial seals it is geometrically not possible to reduce the gap. It is generally believed by those skilled in the art that radial seals are not feasible. Under certain conditions, however, radial solder seals are as repeatable as the best planar seals. The significant parameters are: viscosity and surface tension of the solder at sealing temperature, seal gap thickness and depth, wetting characteristics of the surfaces, and the gas content of the solder and of the solder to wall interface. A relatively low viscosity of the solder at sealing temperature is necessary so that the solder can flow freely. The surface tension of the liquid solder to itself and to the sealing surfaces provide the force necessary for the formation of a liquid solder droplet. The proper gap geometry can be used to enhance the surface tension forces that produce said liquid droplet. Surface tension force between a liquid and the walls of a confining vessel is sometimes referred to as capillary force. The substantial absence of gas pockets in the solder and in the solder to wall interface, at vacuum sealing, enhances the formation of continuous solder seals.

A tubing is the preferred cofiguration for the vacuum envelope for its simplicity, although bulb type envelopes may be utilized. The tubing may be of the hard or soft glass variety, depending on the desired application. Soft glass of the soda lead or lime type is preferred for the purposes of this invention. These glasses may be expansion matched with glass solders or relatively low sealing temperatures. It is of course preferred to work at low temperatures in order to minimize the total thermal contraction of the components, and hence reduce residual stresses.

Solder glass applied in a slurry form to the envelope opening is a viable method of solder application. The vehicle for the solder glass powder may be any liquid with a boiling temperature below that of sealing temperature, and with the proper viscosity for working. For the purposes of this invention, Nitro Cellulose in Butyl Acetate ad Acetone is preferred. Iso Butyl Methacrylate or Butyl Carbitol based vehicles are of course also quite suitable for the purposes of this invention. These vehicles produce a good consistent and workable slurry when mixed with the solder glass powders The exhaust opening may be obtained by various methods. Intergranular opening is preferred for the purposes of this invention. This opening is obtained by using a relatively thin slurry with relatively large grain size, such that when the "low" boiling vehicle evaporates, adequate inter granular holes or openings are formed for evacuation. For the soft glass sealing systems, thermal expansion matching Nickel-Iron alloy lead is preferred, however Dumet or Platinum wire may also be used. Conventional wet hydrogen firing is used to normalize and oxidize the lead wire. For the hard glass (high temperature) sealing sytems Nickel-Iron-Cobalt alloy, Molybdenum or Tungsten wire may be used.

At assembly of the bulb, the leaded filament is inserted into the envelope and held in position in a fixture. The leads are placed concentric with the exhaust seal opening and the solder is applied. In the case of a tubuler envelope, the lead is placed concentric with the tube. It was found in practice that a solder depth of 1½ to 2 bore diameters give excellent seals.

Another very useful method for the application of the solder or sealing material to the envelope and the lead wire utilizes solid formed annular plugs. These plugs are made of glass or metal with flow temperatures substantially below that of the envelope. The plug substantially fills the space between the envelope opening and the lead wire. Said plug however has sufficient clearance gap from the envelope or the lead so that said gap may be utilized to evacuate the envelope. A channel may also be formed in the plug for evacuation purposes. In the case of gas filled envelopes, said gap or channel may also be used subsequently to fill the envelope with the desired gas. The subject plug may be made, for example, of low melting point lead oxide based glass tubing such as Corning 7570. This is a non de-vitrifying composition, and this is preferred for its simplicity of the seal parameters. De-vitrifying glasses such as Corning 7587 or 7589 may be used, of course, to good advantage for elevated temperature operation. Various metal solders will form very strong and reliable seals when the aforesaid plug is made of such metal solder. Metals and alloys of Indium, Gallium, Tin, Lead, and Bismuth are suitable for the embodiment of this invention.

The metal solder may be applied by various methods. For the purposes of this inventin the use of preformed metal plugs are preferred. The metal solder may be applied however in a slurry form also, as described for glass solder. It must be emphasized that the glass envelope opening and the lead wire must be scrupulously clean for high vacuum sealing.

The filament, lead and envelope assembly must obviously be made prior to the evacuation and sealing operation. The components must also be properly located relative to each other for the sealing operation. Three general methods of approach may be applied to the fixturing requirement: external fixturing, self fixturing, and a combination of the two. In the case of external fixturing, the filament wire is attached to the lead wires by any of the conventional methods such as resistance spot welding, clamping or a combination of these methods. The filament lead assembly is inserted into the evenlope. The envelope and the filament leads are inserted into a locating fixture and are "clamped" into the proper position relative to the three co-ordinate axes. The solder is applied by one of the methods stated above, and the assembly is ready for evacuation and sealing.

For complete self fixturing the filament lead is made in such configuration that it centers and axially locates on the envelope. The lead and envelope geometry may be such that they self align in the radial direction, and a fixture is used to locate in the axial direction.

The primary object of this invention is to provide an inexpensive evacuation and sealing structure for vacuum devices.

Another object is to provide an inexpensive evacuation and lead sealing structure for light bulbs.

Yet another object is to provide a vacuum envelope which is well suited for subminiature devices.

Still another object is to provide an inexpensive yet exceedingly compact vacuum envelope, exhaust port, lead seal and envelope seal structure.

Other objects and advantages of the invention will become readily apparent from the following description when taken in conjunction with the accompanying drawings in which.

Figure 1:
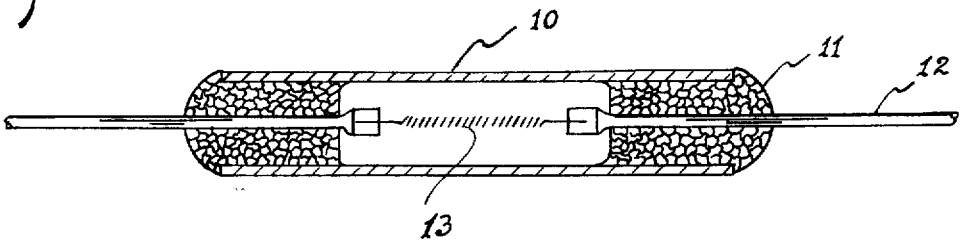
FIG. 1 is a cross sectional view of the light bulb with granular slurry applied.

Referring to FIG. 1 solder slurry 11 is in the openings of capillary glass tubing 10 enclosing lead wires 12 with filament 13 located along the tube axis. It was found in practice that capillary tubing 10 with 0.3 to 0.5 mm bore, produces more than adequate capillary forces in conjunction with 325 mesh Corning 7570 powder glass at 535°C. A corresponding expansion matched glass for the capillary tubing 10 is Corning 0080, it has an annealing temperature of 510°C, hence the capillary tubing 10 is stress relieved at sealing temperature.

The solder slurry 11 for this system is made up as follos:

4 gm Nitro Cellulose
20 gm Corning 7570, 325 mesh powder
16 cc Butyl Acetate
5 cc Acetone Acetone is added as required to make a workable slurry that can be applied to the capillary. The Acetone tends to evaporate fast, so tha it has to be replenished frequently. In order to obtain a moe stable slurry, 3.5 cc of Butyl Carbitol (Diethylene Glycol Monobutyl Ether) may be added to the above slurry.

The firing schedule for a given slurry and oven is obtained by increasing the temperature in given time increments so that the pressure is maintained below $1 \times 10^{-4}$ Torr. The sealing temperature of 535°C. is maintained for 7 minutes.

The preferred material of the lead wire 12, for the Corning 7570 solder glass seal is the Driver Harris No. 52 Nickel Iron Alloy. The lead wire 12 should be about 0.08 mm in diameter for the 0.3 to 0.5 mm bore capillary tubing 10. The wire 10 is annealed and oxidized, according to state of the art procedures, in wet hydrogen.

Figure 2:
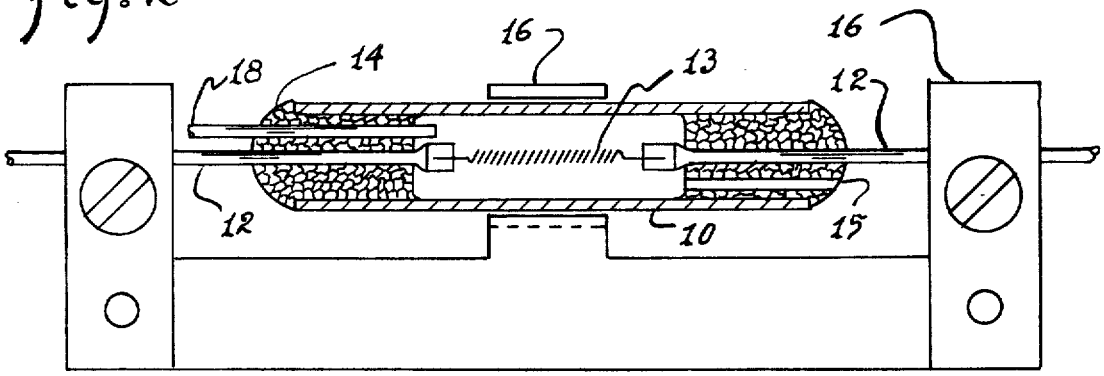
FIG. 2 is a cross sectional view of the light bulb, with applied slurry ad exhaust channel, in an assembly fixture.

Referring to FIG. 2 a bulb assembly is shown inserted into firing fixture 16. The lead wires 12, and the tubular envelope 10 are clamped into jaws of fixture 16. The solder plug 14 has an exhaust hole 15 for evacuation purposes. The volume to be evacuated is relatively small for the 0.5 mm bore envelope of about 3 mm length, so that an exhaust hole of about 0.05 mm diameter and 0.6 mm long is adequate for rapid pumping. The plug 14 was formed in similar manner as described for FIG. 1 except a 0.05 mm diameter wire 18 was inserted into the capillary tubing 10, before the application of the solder slurry. After the slurry plug 14 binder is set, wire 18 is pulled out thereby forming hole 15. Evacuation and sealing is accomplished as described for the device in FIG. 1. During sealing the exhaust hole collapses, due to surface tension forces; and substantially no sign of the exhaust hole is evident in the finished seal.

Figure 3:
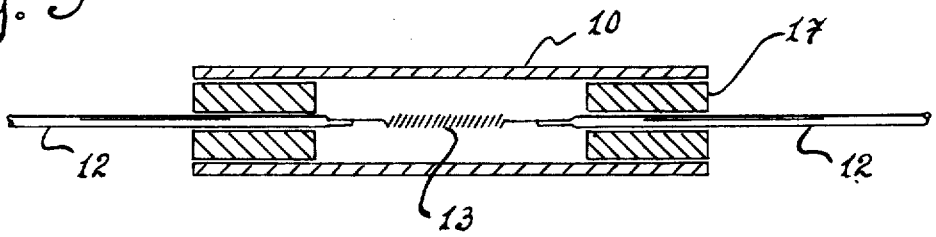
FIG. 3 is a cross sectional view of the light bulb, with solder plugs in position, before sealing.

Referring to FIG. 3, a cross section of the bulb is shown with preformed solder plug 17, in tubular envelope 10. The clearance between the plug 17 and the lead wire 12 should be about 0.02 mm, for 0.08 mm lead wire 12 diameter. The clearance gap between the solder plug 17 and the tubular envelope 10 should be about 0.03 to 0.04 mm for a .5 mm bore diameter envelope 10. The above gap gives an adequate exhaust port. Solder plug 17 length should be about 1 mm. The preferred material for the solder plug 17 is solder glass tubing, although metal solders may also be used. For the Corning 0080 envelope 10 and DH52 alloy wire lead 12, solder plug 17 made of drawn tubing of Corning 7570 glass gives seals of excellent repeatability and quality. After the bulb assembly process, binder is placed between the envelope 10 and the plug 17, in order to hold the assembly together for loading into the oven.

Metal solder may also be used for the makeup of the solder plug 17, for low power bulbs since the envelope remains essentially at room temperature. Indium is the preferred material for the metal solder plug 17, it has a melting point of 156°C and a thermal expansion of $33 \times 10^{-6}$/°C. There is a considerable expansion mismatch between a soft glass envelope 10 and an Indium plug 17, however, the sealing temperature is so low that the total strain developed is within allowable limits. Flux is generally not needed for Indium soldering on glass and ferrous metal surfaces, when the surfaces are properly cleaned. Care must be taken, however, that the seal is not overheated at soldering the bulb leads into electrical terminals.

It will be appreciated by those skilled in the art, that the invention may be carried out in various ways and may take various forms and embodiments other than those illustrative embodiments heretofore described. Accordingly, it is to be understood that the scope of the invention is not limited by the details of the foregoing description, and I intend by the following claims to cover all modifications within the spirit and scope of my invention.

What I claim to be new and desire to secure by letters patent of the United States:

1. An incandescent light bulb comprising an envelope of insulating material, a filament contained within said envelope, said filament having its conductive extremities extending beyond said envelope, said filament extremities are sealed to said envelope by a solder glass or metal solder with flow temperatures substantially below that of said envelope.

2. The invention as described in claim 1 wherein said envelope is substantially cylindrical, and said conductive extremities of the filament extend at the end of said cylindrical envelope.

* * * * *